US005833529A

United States Patent [19]

Jacob

[11] Patent Number: 5,833,529

[45] Date of Patent: Nov. 10, 1998

[54] FUME HOOD EXHAUST TERMINAL HAVING AN ELECTRICALLY DRIVEN LINEAR ACTUATOR

[75] Inventor: Steven D. Jacob, Crystal Lake, Ill.

[73] Assignee: Landis & Staefa, Inc., Buffalo Grove, Ill.

[21] Appl. No.: 814,076

[22] Filed: Mar. 10, 1997

[51] Int. Cl.[6] ..... B08B 15/02

[52] U.S. Cl. ..... 454/61; 251/129.12; 251/228

[58] Field of Search ..... 454/56, 61; 137/486, 137/487.5; 251/129.11, 129.12, 266, 267, 228

[56] References Cited

U.S. PATENT DOCUMENTS 1,926,120 9/1933 Snediker .
3,993,096 11/1976 Wilson .
4,418,719 12/1983 Downs, Jr. et al. .
4,472,999 9/1984 McCabe .
4,605,198 8/1986 Greiner .
4,784,114 11/1988 Muckler et al. ..... 126/299 E
5,106,052 4/1992 Datta .
5,278,454 1/1994 Strauss et al. .
5,518,446 5/1996 Jacob .
5,519,295 5/1996 Jatnieks .

*Primary Examiner*—Harold Joyce
*Attorney, Agent, or Firm*—Greer, Burns & Crain, Ltd.

[57] ABSTRACT

A fume hood exhaust terminal for controlling gas flow in an exhaust duct has an electrically driven linear actuator for angularly positioning a damper in the terminal. Drive circuitry employed in the preferred embodiment prevents the possibility of shorting out the actuator motor in the event of an input signal condition which would attempt to operate the motor in two directions simultaneously. The circuit also includes a power failure detection circuit which includes the capability of storing sufficient power to place the damper in a preferred position until power is restored to the exhaust terminal.

11 Claims, 4 Drawing Sheets

FUME HOOD EXHAUST TERMINAL HAVING AN ELECTRICALLY DRIVEN LINEAR ACTUATOR

The present invention generally relates to laboratory fume hood installations, and particularly to exhaust terminals that are used in such installations. Still more particularly, the present invention relates to fume hood exhaust terminals that have an electrically driven linear actuator for controlling the position of a damper in a fume hood exhaust terminal.

Fume hoods are provided in laboratories for removing toxic fumes and gases in the air that are often produced during experimental work that is done in the laboratories. Generally, fume hoods include an enclosure with doors that can be opened vertically and/or horizontally to enable technicians to gain access to the interior of the fume hood for doing experimental work. The fume hoods generally have an exhaust duct provided to expel air and gaseous fumes so that the laboratory technicians will not be exposed to them while working near the hood.

Fume hood controllers are employed to control the flow of air through the fume hood and such controllers generally control the flow as a function of the desired average face velocity of the effective opening of the fume hood at any particular time. The average face velocity is generally defined as the flow of air into the fume hood per square foot of open face area of the fume hoods, with the size of the open face area being a function of the position of the one or more moveable doors that are provided on the front of the fume hood. The average face velocity is determined by the operators of the facility where the fume hoods are located, and therefore can be set at a higher or lower face velocity that is consistent with the operator's sense of what is a safe value, and yet is not wasteful of energy costs. Such average face velocities are generally in the range of 100 ro 150 feet per minute for each square foot of open area when technicians are present in the area.

Fume hood installations can also vary in their design and operation. Some installations have controllers that control a variable speed drive for driving a fan motor for the purpose of modulating the flow of air through the fume hood to provide the desired average face velocity. There are also many installations which have a single blower in a common exhaust manifold with a number of fume hoods having individual exhaust ducts connected to the manifold, with the flow of air through each fume hood being controlled by a damper mechanism. The damper mechanism can be located in a fume hood exhaust terminal generally of the type as disclosed in my prior U.S. Pat. No. 5,518,446, assigned to the same assignee as the present invention (albeit that the assignee's name has been changed since the patent issued). As disclosed in my '446 patent, there are many damper controlled applications which utilize a pneumatic actuator for the purpose of positioning the damper to modulate the flow of air through the hood. While such pneumatic actuators do operate reliably, there is a need for an electrically driven linear actuator which is cost-effective and reliable in its operation. Additionally, while rotary electrical actuators are known to have been used for damper applications, they are usually more complex in their design and construction.

Also, there are many existing installations where fume hood controllers are installed which operate to control pneumatic damper actuators. While such installations may continue to operate quite acceptably, there may be a desire or need to utilize an electrical damper actuator in the future.

Accordingly, it is a primary object of the present invention to provide a fume hood exhaust terminal having an electrically driven linear actuator for use in fume hood installations, as well as other applications, which linear actuator is simple in its design, is highly reliable and relatively inexpensive to produce.

Another object of the present invention is to provide such an improved fume hood exhaust terminal having a linear actuator which has rapid operation to quickly change the damper position and thereby accurately control the modulation of the flow through the fume hood during operation.

Still another object of the invention is to provide an improved fume hood exhaust terminal having an electrically driven linear actuator that can be easily installed as a retrofit for an existing pneumatic damper, and wherein the controller need not be modified to any significant extent because the control signals that had previously controlled the pneumatic actuator can be used to control the electrically driven linear actuator.

Yet another object of the present invention is the provision for electrical drive circuitry which has the capability of placing the damper in a preferred position even if the power to the circuitry is interrupted, thereby providing an emergency fail safe capability.

Still another object of the present invention lies in the provision of a simple inexpensive power failure detection circuitry which automatically activates the remainder of the drive circuitry to open the damper to provide maximum flow through the fume hood to thereby provide an optimum safety condition.

Yet another object of the present invention is to provide an improved fume hood exhaust terminal having a drive circuitry which is unique in its design and operation and which is adapted to reliably drive the actuator motor while minimizing the possibility of damaging the drive motor by continuing to power the motor when the actuator mechanism has reached the end of its travel in either direction.

Other objects and advantages will become apparent upon reading the following detailed description, while referring to the attached drawings, in which.

Figure 5:
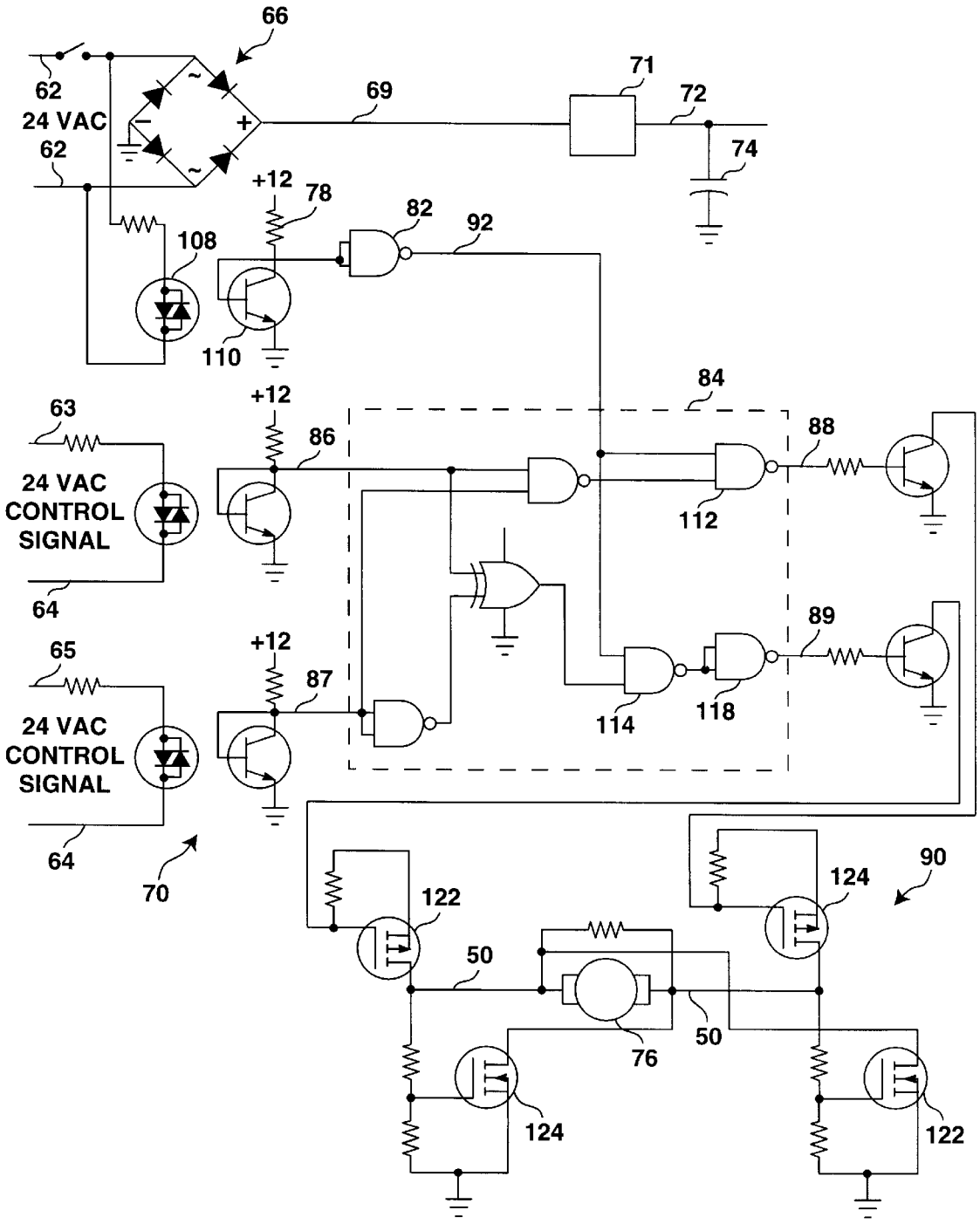
Figure 6:
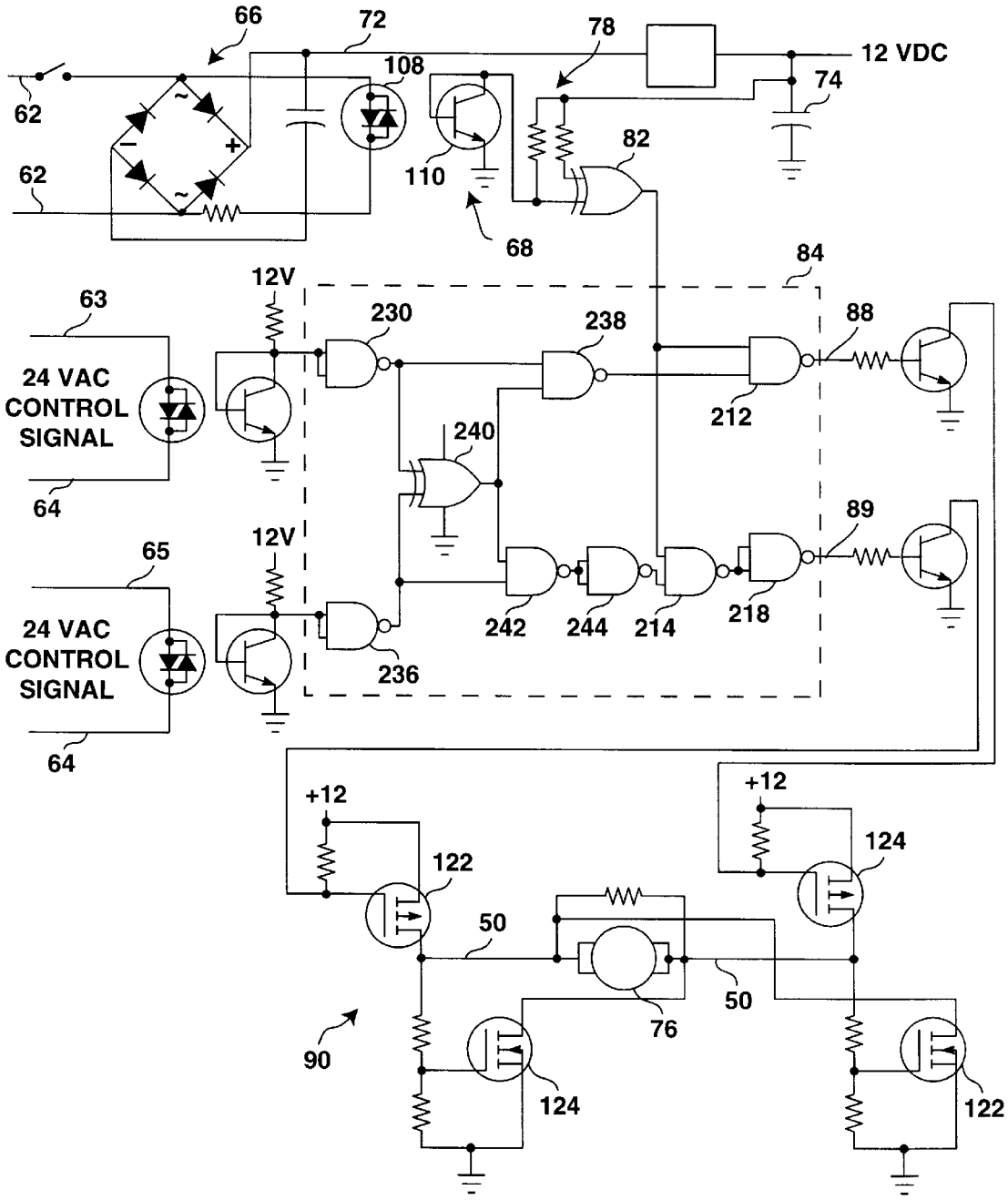

FIG. 5 is a detailed electrical schematic diagram illustrating the preferred embodiment of the electrical circuitry that is used to detect power failure and to drive the motor of the exhaust terminal embodying the present invention; and, FIG. 6 is a detailed electrical schematic diagram illustrating an alternative embodiment of the electrical circuitry that is used to detect power failure and to drive the motor of the exhaust terminal embodying the present invention.

DETAILED DESCRIPTION

Broadly stated, the present invention is directed to an improved fume hood exhaust terminal having an electrically driven linear actuator for controlling the angular position of a damper for modulating the flow through the exhaust duct of a fume hood. The desired flow through the exhaust duct is determined by a fume hood controller that is not in and of itself a part of the present invention. The present invention is directed to a fume hood exhaust terminal having an electrically driven linear actuator and control circuitry for driving the same.

Figure 1:
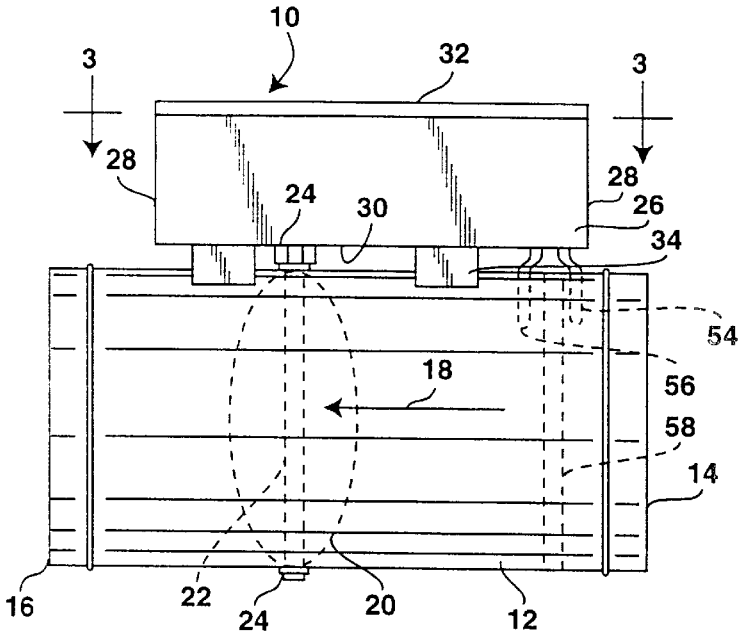
FIG. 1 is a side view of a fume hood exhaust terminal embodying the present invention.

Turning now to the drawings, and particularly FIG. 1, a fume hood exhaust terminal, indicated generally at 10, is shown in side view and generally comprises a tubular duct segment 12 having an upstream end 14, a downstream end 16, with flow thereby passing through the duct segment in the direction of the arrow 18. A flat generally disk-shaped rigid damper 20 is positioned inside of the duct segment 12 and is preferably mounted to a shaft 22 that is rotatably journaled in a polymeric low friction, preferably Teflon-type bushing 24 in both the upper and lower ends, with the shaft extending through suitable apertures (not shown) in the tubular segment 12. As an alternative to the damper shaft 22 which extends through the damper 20, there may be upper and lower cylindrical portions that extend from near the periphery of the damper 20, if desired. In either type of construction, the shaft and the cylindrical portions are coextensive along an axis that passes through the center of the damper 20.

It should also be understood that the exhaust terminal shown in FIG. 1 should not be limited to a disk-shaped rigid damper as particularly illustrated, but can be used with any exhaust terminal having a damper construction which is controlled by a lever arm pivoting a shaft that controls the amount of flow through the damper duct. One such type of damper is disclosed in U.S. Pat. No. 4,155,289 issued to Garriss. It should also be understood that while the present invention is directed to an exhaust terminal, it is meant to be considered in a broad sense, in that a damper construction can be incorporated in a unitary exhaust terminal, or can be installed in an exhaust duct, or can just as easily be installed in a portion of the exhaust duct of the fume hood itself. It is within the scope of the present invention, that the present invention may be incorporated in the construction of the fume hood by the manufacturer of the fume hood.

Figure 3:
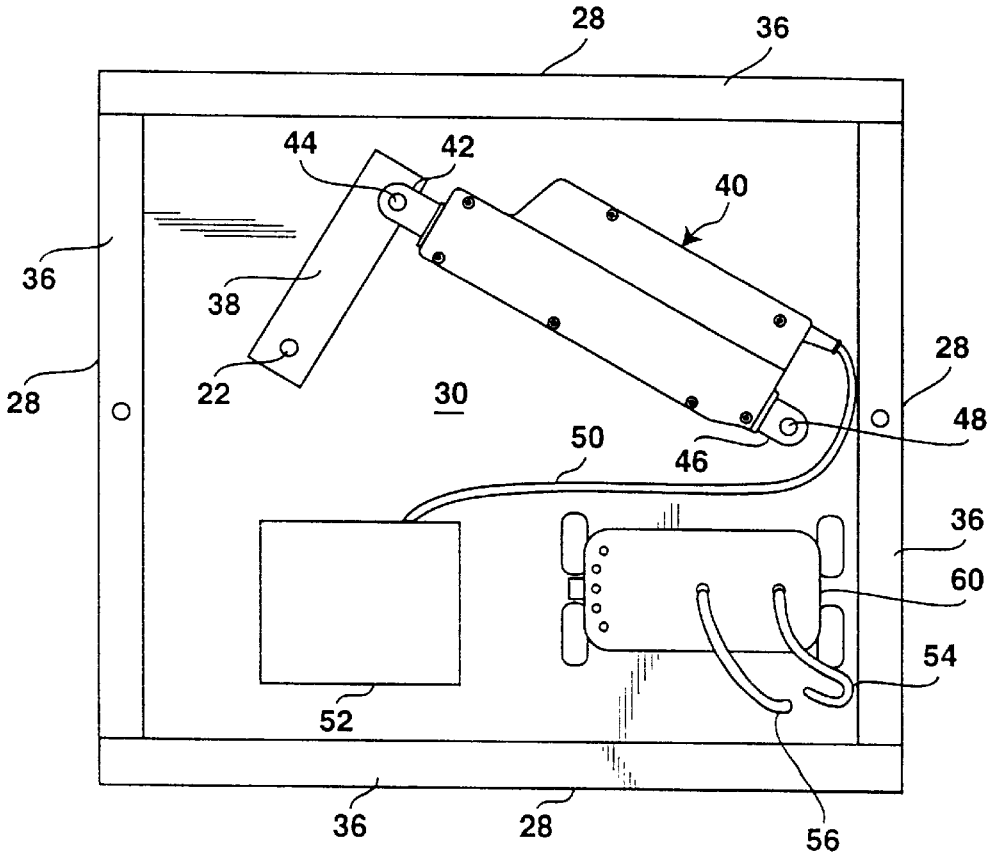
FIG. 3 is a top view taken generally along the line 3—3 of FIG. 1, and illustrating the linear actuator portion of the present invention, together with other portions;.

The apparatus includes an enclosure 26 which has four sidewalls 28, a bottom wall 30 and a top plate 32. The enclosure 26 is supported by and attached to the tubular segment 12 by mounts 34 that are attached by suitable attachment means, such as weldments, bolts, sheet metal screws, or the like. Referring to FIG. 3, the enclosure 26 also has a narrow top flange 36 that extends around the entire periphery of the enclosure. This provides a surface that is suitable for attaching the top plate 32 to the enclosure by screws or the like. The shaft 22 extends upwardly through the bottom wall 30 of the enclosure where it is coupled to a lever arm 38 at one end thereof, with a linear actuator mechanism, indicated generally at 40, having a piston rod end portion 42 with an aperture in it, through which a pin 44 is placed for interconnecting the piston rod end 42 with the lever arm plate 38. The opposite end of the actuator mechanism 40 has a mounting end portion 46 which has a stud 48 attached to the bottom 30 with the stud 48 passing through a similar aperture in the mounting end portion 46 to firmly secure the actuator mechanism 40 to the enclosure. Thus, during operation, the piston rod end portion 42 extends and retracts thereby rotating the lever arm plate 38 about the shaft 22 to change the angular position of the damper 20 as desired.

The actuator mechanism 40 includes an internal motor, not shown in FIG. 3, which is driven by electrical lines 50 that extend to a circuit module 52, which together with the internal motor, is shown in FIGS. 3, 4, 5 and 6. Referring again to FIG. 1, the apparatus includes hollow tubes 54 and 56 which are positioned on opposite sides of an annular flange 58, with the tubes extending to a transmitter 60 which feeds information relating to the differential pressure across the flange 58 back to the fume hood controller. The controller uses this information to determine the proper air flow through the segment 12. The manner in which the flow is measured through the segment 12 is not considered to be a part of the present invention, although it is understood that many of such exhaust terminals often have this capability. It should also be understood that the flow of air through the exhaust can be measured upstream or downstream of the tubular duct segment 12.

Figure 2:
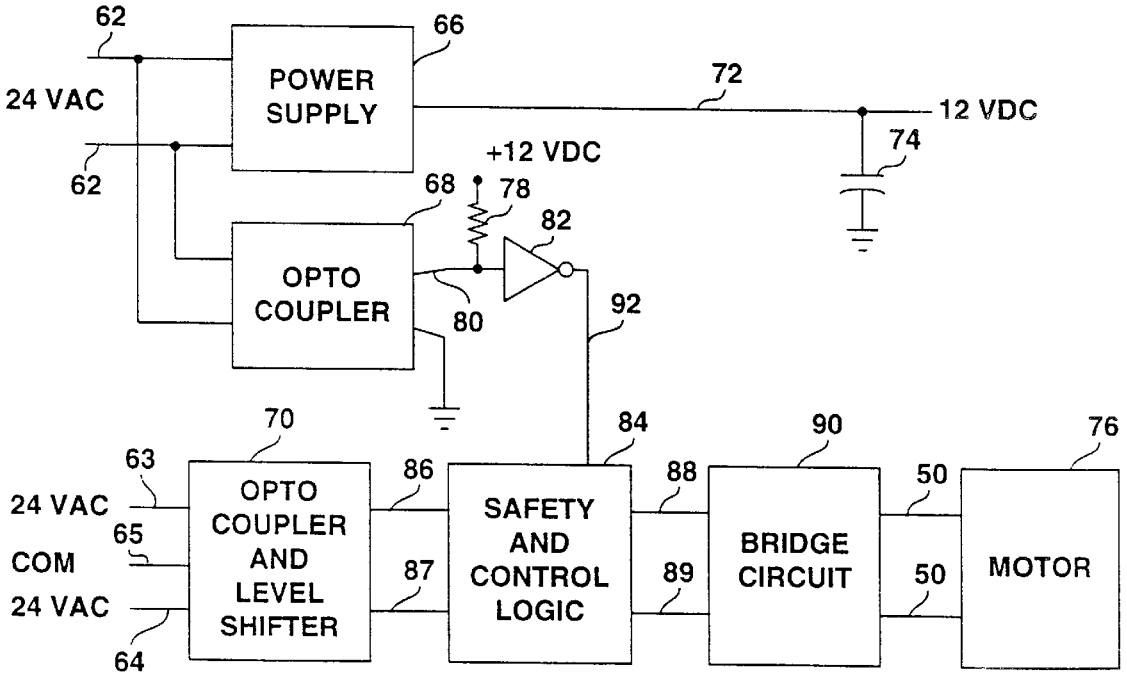
FIG. 2 is a block diagram of the electrical circuitry that operates the improved fume hood exhaust terminal of the present invention.

Turning now to FIG. 2 which illustrates the block diagram of the circuitry that is employed in the preferred embodiment of the present invention, 24 volts alternating current (VAC) is applied at lines 62 which connect to a power supply 66. The output of the power supply 66 is connected to an opto-coupler 68 via line 72. The power supply 66 provides a 12 volts direct current (VDC) output on line 72. The output line 72 is connected to a capacitor 74 which is charged during normal operation and which provides sufficient charge to operate a motor 76 within the actuator mechanism 40, to cause it to return the damper to a preferably fully open position. This occurs when the piston rod end 42 is fully retracted within the actuator mechanism 40. The output line 72 is also connected to a resistor 78. The output of the opto-isolator 68 is applied to line 80 that is connected to the opposite end of resistor 78 and to an inverter 82 which is connected to safety logic circuitry 84. The output of opto-coupler and lever shifter circuit 70 appears on lines 86 and 87 which extend to the safety logic circuitry and the safety logic circuitry in turn is connected via lines 88 and 89 to a bridge circuit 90 having output lines 50 that are connected to the motor 76. The inverter 82 is connected to the safety logic circuitry 84 via line 92.

Control signals from a fume hood controller for causing retracting and extending movement of the actuator 40 is applied via lines 63, 64 and 65 to an opto-coupler and level shifter module 70. It should be understood that there are two 24-VAC input lines 63, 64 connected to the opto-coupler and level shifter block 70 for the reason that each of them drives the motor 76 in a different direction. This causes the damper to be moved in opposite directions depending upon activity of the control signals. In this regard, the embodiment shown in FIG. 5 operates as a combination of the inputs, whereas the embodiment of FIG. 6 retracts to open the damper when the input line 63 is active and extends to open the damper when input line 64 is active. When the motor is energized, the piston rod end 42 is caused to be extended or retracted depending upon the speed of operation of the motor. It should also be understood that the apparatus of the present invention can be adapted to cause the actuator to retract so that the damper is fully closed, rather than caused to fully open. Such a result may be desired if the damper is controlling the operation of an air supply damper for a room. Depending upon the application, the safety consideration may be for fully opening the damper or fully closing it. Both types of applications are within the scope of the present invention.

Figure 4:
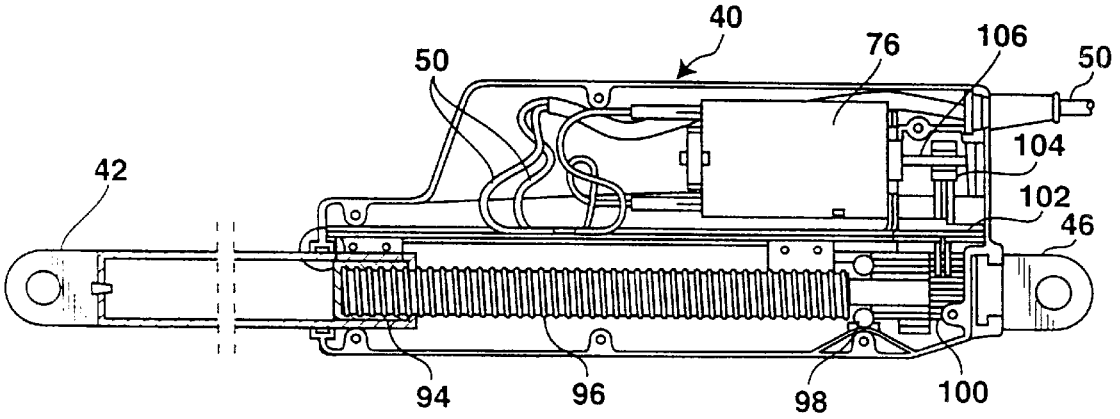
FIG. 4 is a side view with portions removed and partially in section illustrating the linear actuator mechanism that is employed in the exhaust terminal embodying the present invention.

In this regard and referring to FIG. 4, the piston rod end 42 has an internal threaded end 94 which engages a threaded screw 96 that is journaled in bearing 98. The screw 96 has an attached gear 100 which engages an intermediate gear 102 that in turn is driven by an output gear 104 attached to the output shaft 106 of the motor 76.

With respect to the embodiment illustrated in the circuit diagram illustrated in FIG. 5, components that have been described with respect to FIG. 2 are also identified in this drawing. This embodiment has the advantage of being adapted to be retrofitted into many existing fume hood control installations which operate a damper that is pneumatically controlled. Thus, the control signals that are generated for such an application can be used to operate the present invention having its electrically actuated linear actuator. In this control scheme, the circuitry implements a truth table which operates as follows: a) if both inputs 63 and 64 are not active, the actuator retracts to open the damper; b) if either of inputs 63 or 64 are active, the actuator is held in place; and, c) if both inputs 63 and 64 are active, the actuator extends to close the damper.

Referring to the upper left corner of FIG. 5, power is supplied via lines 62 to a diode bridge which is the heart of the power supply 66 and its output, which is a 24 VDC voltage is on line 69. Line 69 is then applied to a voltage converter 71 which converts the voltage level to 12 VDC. The output of the converter 71 on line 72 extends to the capacitor 74 which is preferably a relatively large capacitor, such as about 0.2 farads for example. The most important consideration is that the capacitor 74 provide sufficient power so that the actuator can be moved from whatever position it was to the fully retracted position which results in the damper being fully open. It should be understood that several smaller capacitors can be used rather than one large capacitor as shown. The use of several smaller capacitors may enable easier production techniques such as the use of plug-in components, for example. The opto-isolator 68 which comprises a dual light emitting diode 108 that can be activated by an AC signal and photo-transistor 110, the latter of which provides output on line 80 that is applied to an inverter 82 which provides a low signal on line 92 when AC power to the input lines 62 fails.

Thus, the opto-coupler 68 and inverter 82 provides a signal that is used to sense whether the power has dropped out and if it has, results in energization of the motor 76 to fully retract the piston rod end 42 into the actuator 40. The line 92 is connected to one input of each of AND gates 112 and 114, so that when line 92 goes low, it will create a high signal on output line 88 which will result in the motor being activated. At the same time, by virtue of gate 114 being connected to an intermediate gate 118, line 89 will be deactivated and will preclude the motor running in the direction to extend the piston rod end as is desired. When the actuator reaches the end of its travel and is in its retracted position, an internal limit switch which will shut off the motor. In this regard, it is preferred that the actuator be a model LA12 actuator made by the Linak Company. This model has a maximum thrust of approximately 40 pounds, although models are available that have a thrust of up to about 100 pounds. The actuator operates on either 12 or 24-volts DC power, has a reinforced glass fiber piston rod and built in limit switches. Its overall retracted length is almost 10 inches and it has a stroke length of approximately 2.8 inches although a longer stroke is available. The use of a model having a shorter stroke, coupled with the length of the arm 38 affects the speed of movement through its range of travel. It should be understood, however, that other models and manufacturers of such products may be used.

The drive circuitry 90 for the motor is a standard H-bridge type circuit so that when one set of the field effect transistors 122 is turned on, the motor is driven in the direction that produces a retraction of the piston rod end. Similarly, when the other set of field effect transistors 124 are turned on, the motor is driven in the opposite direction. The application of voltage on the retract direction input line 63 activates a dual light emitting diode 126 and a corresponding photo-transistor 128 is activated to provide a low level on the input of an inverter 130. Similarly, if the fume hood controller provides a signal to move the damper in the opposite direction, then the extend input voltage is applied which activates a dual light emitting diode 132 which causes a photo-transistor 134 to go into conduction which applies a low signal to an inverter 136.

With respect to the circuitry illustrated in FIG. 6, it is directed to an alternative embodiment for carrying out the general operation of the block diagram shown in FIG. 2. Reference numbers for components that are substantially similar to those shown in FIGS. 2 and 5 are used in FIG. 6. In this circuit, the output of the inverter 230 is connected to another inverter 238, as well as to an exclusive-OR gate 236 and the output of the inverter 236 is applied to the other input of the exclusive-OR gate 236 as well as to an inverter 242. The output of inverter 242 is inverted by an inverter 244, the output of which is applied to the NAND gate 214. The operation of the exclusive-OR gate 236 is such that only one of the lines 88 or 89 can be active at any time thereby preventing both sets of field effect transistors 122 and 124 from being turned on at the same time. In the event that such would occur, the motor would be shorted out.

From the foregoing description, it should be appreciated that a fume hood exhaust terminal for controlling gas flow in an exhaust duct has been shown and described which has many superior operational characteristics and is reliable in its operation. The use of an electrically driven linear actuator for angularly positioning the damper in the terminal has been shown to be simple in design, which contributes to its simplicity and reliability of operation. Additionally, the drive circuitry employed in each of two embodiments is simple in its design and is effective to accurately control the damper position in a rapid manner. One embodiment is particularly suited to retrofitting a pneumatically operated damper and utilizes the type of control signals employed by such pneumatic fume hood controllers. The alternative embodiment provides effective use of conventional control signals that are not analogous to a pneumatic type of control and yet prevents the possibility of shorting out the actuator motor in the event of an input signal condition which would attempt to operate the motor in two directions simultaneously. Both embodiments of the circuitry also include a power failure detection circuit which includes the capability of storing sufficient power to place the damper in a preferred position until power is restored to the exhaust terminal.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A fume hood exhaust terminal for controlling gas flow in an exhaust duct, comprising;

a duct segment having an upstream end, a downstream end and an inner periphery;

a damper disposed in said duct segment adapted to vary the flow of gas passing through said segment between the range of approximately no flow and full flow as a function of the position thereof;

means for mounting said damper within said duct segment for opening and closing movement thereof, said mounting means including a lever arm attached to said damper and adapted to move said damper in response to movement of said lever arm;

actuating means having a body portion with an electric drive motor having an output shaft and a piston rod portion that is extendable and retractable relative to said body portion responsive to selective energization of said drive motor, one of said body portion and said rod portion being connected to said lever arm and the other of said body portion and said rod portion being connected to a fixed portion of said terminal so that extension and retraction of said rod portion moves said lever arm and changes the angular position of said damper; and, circuit means for selectively energizing said drive motor of said actuating means to place said damper in a desired angular position in response to first and second electrical input control signals being applied thereto, said circuit means further comprises:

power supply means adapted to be connected to an AC voltage source and provide a DC voltage on an output line;

detecting means connected to said power supply means and being adapted to generate a power fail signal on an output line in response to the absence of an AC voltage at the input of said power supply means;

a bridge circuit adapted to selectively apply DC voltage to said drive motor responsive to receiving said first and second electrical input control signals and supply one of positive and negative conduction to said drive motor to cause its output shaft to selectively rotate in one of clockwise and counterclockwise directions;

an electrical isolation and logic circuit adapted to receive said first and second electrical input control signals and said power fail signal and selectively provide one of said first and second input control signals to said bridge circuit, and to provide a predetermined one of said first and second input control signals to said bridge circuit in response to receiving said power fail signal irrespective of the state of said input control signals when said power fail signal was generated; and, at least one capacitor connected to said output line of said power supply means, said at least one capacitor being connected to said bridge circuit and adapted to provide sufficient power to said drive motor to move said damper to a predetermined position in the event of a detected absence of AC voltage at the input of said power supply means.

2. A fume hood exhaust terminal as defined in claim 1 wherein said duct segment is cylindrical in shape and said damper is a generally flat circular disc with elongated cylindrical portions extending from opposite ends coextensive with an axis extending through the center of said disc, said disc having a diameter that is approximately equal to the inside diameter of said duct segment so that there is generally no flow of gas through the segment when said disc is perpendicular to the length of said segment.

3. A fume hood exhaust terminal as defined in claim 2 wherein said lever comprising an elongated flat plate having one end portion attached to one of said cylindrical portions.

4. A fume hood exhaust terminal as defined in claim 1 further comprising an enclosure having four side walls, a bottom wall and a top wall, one of said walls being removable to permit access thereto, said enclosure being mounted to said duct segment, said enclosure providing said fixed portion of said terminal for mounting one of said body portion and said rod portion.

5. A fume hood exhaust terminal as defined in claim 4 wherein said body portion has an integral mounting end portion with an aperture therein, said end portion being an end opposite the end having the piston rod end.

6. A fume hood exhaust terminal as defined in claim 1 wherein said electrical isolation and logic circuit comprises:

a first opto-isolator means having a first light emitting diode connected to receive said first input control signal, said first light emitting diode being operably coupled to a first phototransistor and providing a true output signal when said first light emitting diode is emitting;

a first invertor connected to the output of said first opto-isolator means;

a second opto-isolator means having a second light emitting diode connected to receive said second input control signal, said second light emitting diode being operably coupled to a second phototransistor and providing a true output signal when said second light emitting diode is emitting;

a second invertor connected to the output of said second opto-isolator means;

an exclusive OR gate having respective inputs connected to the outputs of the first and second inverters;

a first NAND gate having one input connected to the output of the exclusive OR gate and the other input connected to the output of the first inverter;

a second NAND gate having one input connected to the output of the exclusive OR gate and the other input connected to the output of the second inverter;

a third NAND gate having one input connected to the output of said second NAND gate and the other input provided by the output line of said detecting means;

a third inverter connected to the output of said first NAND gate;

a third NAND gate having one input connected to the output of said third inverter and the other input connected to the output of said detecting means; and, a fourth inverter connected to the output of said third NAND gate.

7. A fume hood exhaust terminal as defined in claim 1 wherein said actuating means comprises an elongated screw mounted for rotation within said body portion, and said piston rod portion has internal threads adapted to receive said elongated screw, rotation of said screw causing said piston rod portion to selectively extend and retract relative to said body portion depending upon the direction of rotation of said screw, said screw being operably connected to said drive motor output shaft.

8. A fume hood exhaust terminal for controlling gas flow in an exhaust duct, comprising;

a duct segment having an upstream end, a downstream end and an inner periphery;

a damper disposed in said duct segment adapted to vary the flow of gas passing through said segment between the range of approximately no flow and full flow as a function of the position thereof;

means for mounting said damper within said duct segment for movement, said mounting means including a lever arm fixedly attached to said damper and adapted to move said damper in response to movement of said lever arm;

actuating means having a body portion with an electric drive motor having an output shaft and a piston rod portion that is extendable and retractable relative to said body portion responsive to selective energization of said drive motor, one of said body portion and said rod portion being connected to said lever arm and the other of said body portion and said rod portion being connected to a fixed portion of said terminal so that extension and retraction of said rod portion moves said lever arm and changes the position of said damper; and, circuit means for selectively energizing said drive motor of said actuating means to place said damper in a desired position in response to first and second electrical input control signals being applied thereto, said circuit means comprising:

power supply means adapted to be connected to an AC voltage source and provide a DC voltage on an output line;

at least one capacitor connected to said output line of said power supply means, said at least one capacitor being connected to said bridge circuit and adapted to provide sufficient power to said drive motor to move said damper to a predetermined position in the event of a detected absence of AC voltage at the input of said power supply means;

detecting means connected to said power supply means and being adapted to generate a power fail signal on an output line in response to the detected absence of an AC voltage at the input of said power supply means;

a bridge circuit adapted to selectively apply DC voltage to said drive motor responsive to receiving said first and second electrical input control signals and supply one of positive and negative conduction to said drive motor to cause its output shaft to selectively rotate in one of clockwise and counterclockwise directions.

9. A fume hood exhaust terminal as defined in claim 8 wherein said circuit means further comprises an electrical isolation and logic circuit adapted to receive said first and second electrical input control signals and said power fail signal and selectively provide one of said first and second input control signals to said bridge circuit, and to provide a predetermined one of said first and second input control signals to said bridge circuit in response to receiving said power fail signal irrespective of which of said input control signals was being provided to said bridge circuit when said power fail signal was generated.

10. A fume hood exhaust terminal as defined in claim 9 wherein said electrical isolation and logic circuit causes said motor to move said damper to a full flow position in response to said power fail signal being received.

11. A fume hood exhaust terminal as defined in claim 10 wherein said at least one capacitor is at least about 0.2 farad.

* * * * *